US011260941B2

(12) United States Patent
Cates et al.

(10) Patent No.: US 11,260,941 B2
(45) Date of Patent: Mar. 1, 2022

(54) TABLE ASSEMBLY FOR A WATERCRAFT AND METHOD FOR PRODUCING THE SAME

(71) Applicants: Kirt Cates, Winslow, IN (US); Michael Cronin, Huntingburg, IN (US); Patrick Weiss, Holland, MI (US)

(72) Inventors: Kirt Cates, Winslow, IN (US); Michael Cronin, Huntingburg, IN (US); Patrick Weiss, Holland, MI (US)

( * ) Notice: Subject to any disclaimer, the term of this patent is extended or adjusted under 35 U.S.C. 154(b) by 40 days.

(21) Appl. No.: 16/848,009

(22) Filed: Apr. 14, 2020

(65) Prior Publication Data

US 2021/0047007 A1 Feb. 18, 2021

Related U.S. Application Data

(60) Provisional application No. 62/887,550, filed on Aug. 15, 2019.

(51) Int. Cl.
*B63B 29/04* (2006.01)

(52) U.S. Cl.
CPC ..... *B63B 29/04* (2013.01); *B63B 2029/046* (2013.01)

(58) Field of Classification Search
CPC ..... B63B 29/04; B63B 2029/046
See application file for complete search history.

(56) References Cited

U.S. PATENT DOCUMENTS

2002/0100249 A1* 8/2002 Peng ..... B44C 5/04 52/796.1
2011/0232541 A1* 9/2011 Barracchia ..... A47B 9/00 108/147.19
2015/0054248 A1* 2/2015 Stanislowski ..... F16F 1/3737 280/204
2016/0229496 A1* 8/2016 Foss ..... B63B 29/10
2019/0193918 A1* 6/2019 Mitchell ..... B65D 43/16

* cited by examiner

*Primary Examiner* — Stephen P Avila
(74) *Attorney, Agent, or Firm* — Price Heneveld LLP

(57) ABSTRACT

A table top assembly for a watercraft table assembly includes an upwardly-disposed top surface, a downwardly-disposed bottom surface spaced vertically from the top surface, and a plurality of side surfaces extending between the top and bottom surfaces and cooperating with the top and bottom surfaces to form a body portion, wherein the body portion comprises polyurethane foam having a density within a range of between about 20 lbs/ft$^3$ and about 25 lbs/ft$^3$, and wherein the body portion has a substantially homogeneous composition throughout, and wherein one or more of the top surface and the plurality of side surfaces includes an integrally molded textured surface.

24 Claims, 5 Drawing Sheets

TABLE ASSEMBLY FOR A WATERCRAFT AND METHOD FOR PRODUCING THE SAME

BACKGROUND

The embodiments as disclosed herein relate to a table assembly for a watercraft and a method for producing the same, and in particular a table assembly that includes a polyurethane foam table top with integrated, integral and in-molded accessories and elements. More generally, certain embodiments relate to preparing molded polyurethane foam tables, table components, and other marine accessories.

Over the previous decade, recreational boating has become a popular pastime and the marine industry continues to grow. As a result, the need for onboard furniture such as tables, seating, cup holders, armrests and the like has also increased. Current marine furniture and many marine components are created from relatively expensive plastic molds, are limited in color and options, are relatively heavy in weight, are non-buoyant, and when damaged or scratched expose an unmatched color interior which is difficult and expensive to repair. Further, most marine furniture components available are manufactured via a plastic vacuum forming a process resulting in a relatively smooth exterior surface. Still other components comprise wood which quickly deteriorates and/or discolors over a relatively short amount of time.

SUMMARY

The table top assembly for a watercraft table assembly may include an upwardly-disposed top surface, a downwardly-disposed bottom surface spaced vertically from the top surface, and a plurality of side surfaces extending between the top and bottom surfaces and cooperating with the top and bottom surfaces to form a body portion, wherein the body portion comprises polyurethane foam having a density within a range of between about 18 lbs/ft$^3$ and about 27 lbs/ft$^3$, and wherein the body portion has a substantially homogeneous composition throughout; and wherein one or more of the top surface and the plurality of side surfaces includes an integrally molded textured surface.

The table top assembly for a watercraft table assembly may also or alternatively include a top surface having an upwardly-opening first recess configured to receive a beverage receptacle and an upwardly-opening second recess configured differently than the first recess, wherein the second recess extends over a majority of the top surface, a bottom surface spaced vertically from the top surface and having a downwardly-opening third recess, the third recess having a top wall, and a plurality of side surfaces extending between the top and bottom surfaces and cooperating with the top and bottom surfaces to form a body portion, wherein the body portion comprises polyurethane foam having a density within a range of between about 20 lbs/ft$^3$ and about 25 lbs/ft$^3$, and wherein the body portion has a substantially homogeneous composition throughout, and wherein one or more of the top surface and the plurality of side surfaces include an integral wood-grain pattern.

A method for producing a table top assembly for a watercraft may include providing a mold comprising silicon, the mold including a wood grain textured surface, placing a mixture of polyol and isocyanate into the mold, allowing the mixture of polyol and isocyanate to set into a substantial homogenous body portion of a table top comprising polyurethane foam having a density of within a range of between about 20 lbs/ft$^3$ and about 25 lbs/ft$^3$, and removing the table top from the mold, wherein the body portion of the table top includes an upwardly disposed top surface, a downwardly disposed bottom surface spaced vertically from the top surface, and a plurality of side surfaces extending between the top and bottom surfaces, and wherein one or more of the top surface and the plurality of side surfaces includes an integral wood-grain pattern.

The embodiments as disclosed herein provide marine accessories and components, and in particular table assemblies having an improved quality, a more durable performance, improved aesthetics, are relatively lightweight, are water resistant, are water buoyant, while simultaneously reducing related costs, particularly to short-run batches, and a method for producing the same, and are particularly well adapted for the proposed use.

These and other advantages of the embodiments as disclosed herein will be further understood and appreciated by those skilled in the art by reference to the following written specification, claims, and appended drawings.

DETAILED DESCRIPTION OF THE PREFERRED EMBODIMENTS

Figure 1:
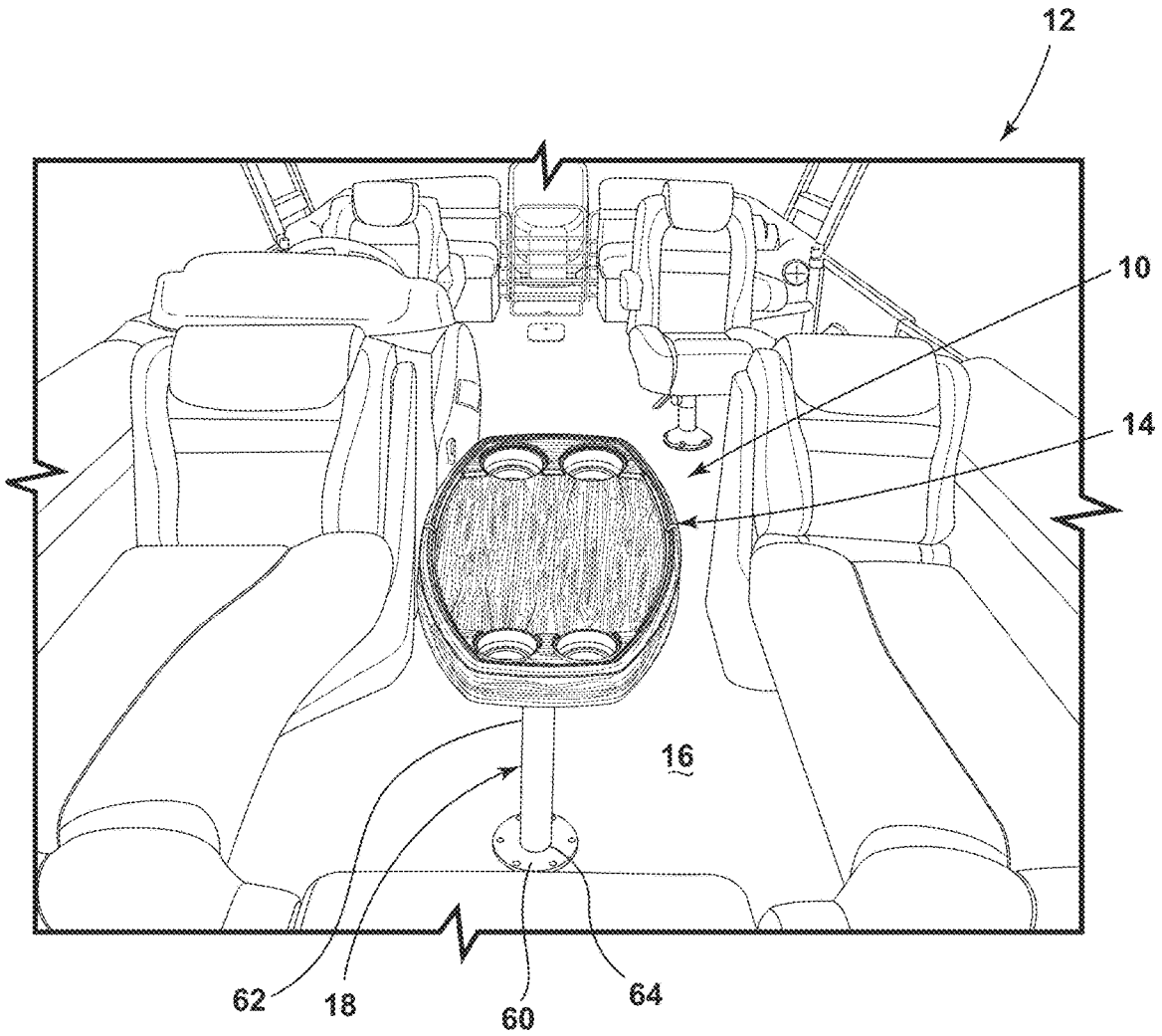
FIG. 1 is a perspective view of a table assembly located within a watercraft, and in particular within a pontoon boat.
Figure 2:
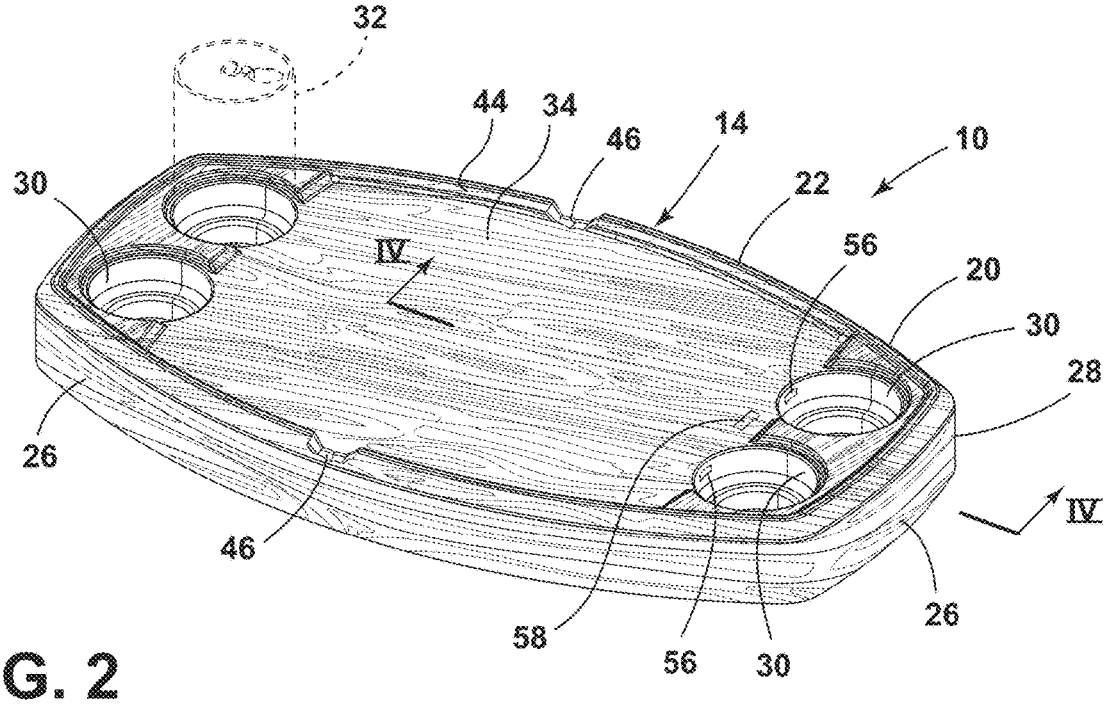
FIG. 2 is a top perspective view of a table top assembly of the table assembly.
Figure 3:
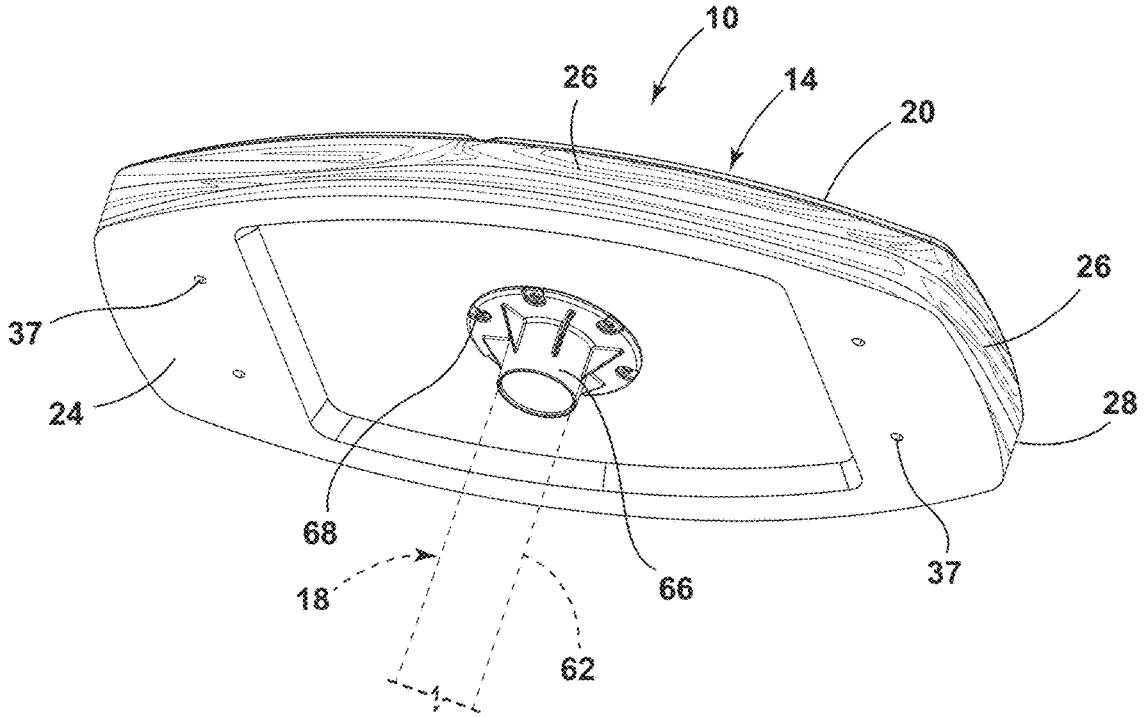
FIG. 3 is a bottom perspective view of the table top assembly.

For the purposes of description herein, the terms "upper," "lower," "right," "left," "rear," "front," "vertical," "horizontal," "top," "bottom," and derivatives thereof shall relate to the embodiment oriented in FIGS. 1-3. However, it is to be understood that the embodiments as disclosed herein may assume various alternative orientations, except where expressly specified to the contrary. It is also to be understood that the specific devices and processes illustrated in the attached drawings, and described in the following specification are exemplary embodiments of the concepts defined in the appended claims. Hence, specific dimensions and other characteristics relating to the embodiments disclosed herein are not to be considered limiting, unless the claims expressly state otherwise.

FIG. 1 illustrates a table assembly 10 shown within an overall marine setting, and in particular supported within a watercraft 12, which as illustrated in FIG. 1 includes a pontoon boat. In the illustrated example, the table assembly 10 includes a table top assembly 14 (FIGS. 1-3) supported above a deck 16 of the watercraft 12 by a support assembly 18.

The table top assembly 14 (FIGS. 2 and 3) includes a table top 20 comprising a polyurethane foam. It is understood herein that polyurethane is a polymer composed of a chain of organic units joined by carbamate links. While most polyurethanes are thermosetting polymers that do not melt when heated, thermoplastic polyurethanes are also available. Polyurethane polymers are traditionally and most commonly formed by reacting a diisocyanate or polyisocyanate with a polyol. Both the isocyanates and polyols used to make polyurethanes contain on average of two or more functional groups per molecule. Polyurethanes are produced by mixing two or more liquid streams. The polyol stream contains catalysts, surfactants, blowing agents and the like. The two components may be referred to herein as a polyurethane system. The isocyanate may be referred to herein as the "A-side" or "iso," while the blend of polyols and other additives may be referred to herein as the "B-side" or as the "poly." The resulted mixture may also be referred to herein as a "resin" or "resin blend."

Figure 4:
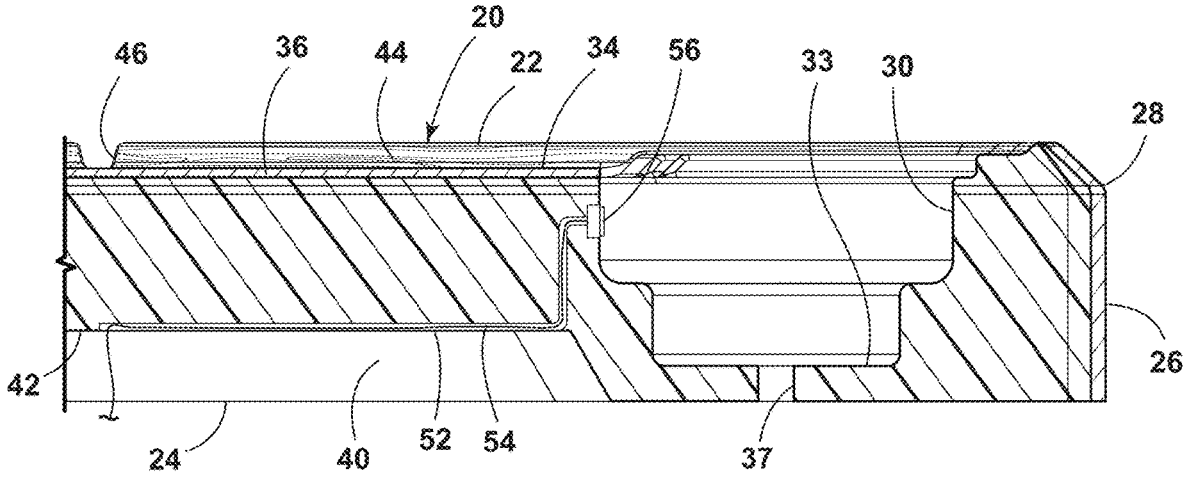
FIG. 4 is a partial cross-sectional side elevation view of the table top assembly taken along the line IV-IV, FIG. 2.
Figure 5:
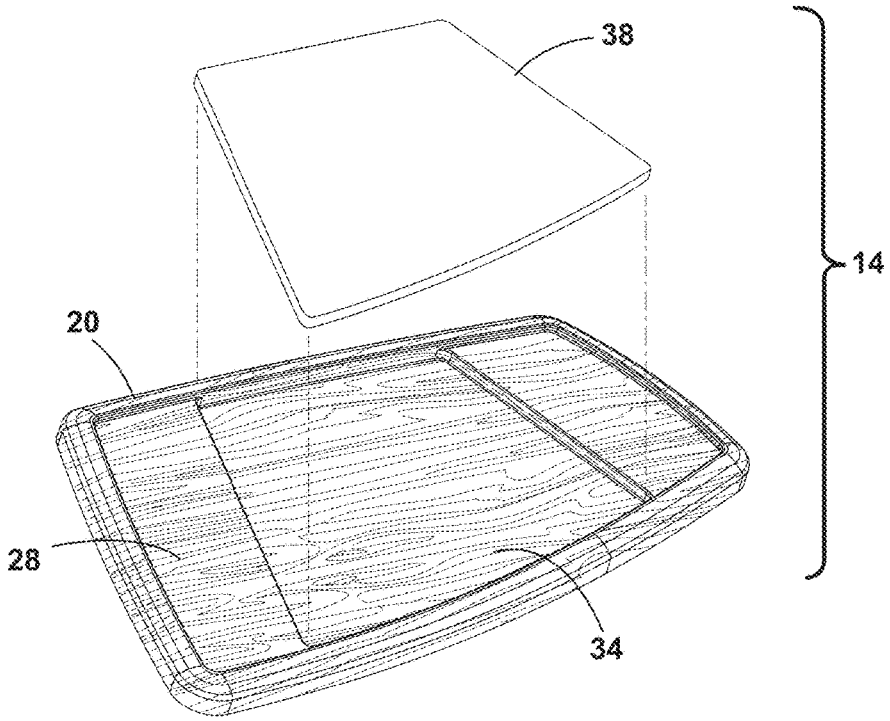
FIG. 5 is an exploded perspective view of the table assembly having an alternative geometrical configuration and including a food cutting and preparation insert.

In the illustrated example, the table top 20 includes an upwardly-disposed top surface 22, a downwardly-disposed bottom surface 24 spaced vertically from the top surface 22, and a plurality of side surfaces 26 extending between the top and bottom surfaces 22, 24 and cooperating the top and bottom surfaces to form a body portion 28. In the illustrated example, the table top 20 incudes a plurality of upwardly-opening first recesses 30 extending downwardly into the top surface 22, where each first recess 30 (FIG. 4) includes a bottom wall 33 and is configured to receive a beverage receptacle 32, such as a glass, can or bottle, therein. Each first recess 30 may also include a drainage portion 37 such that the first recess 30 extends entirely between the top surface 22 and the bottom surface 24, where the drainage portion 37 is configured so as to allow fluids collected in the first recess 30 to drain through the table top 20. The table top 20 may also include an upwardly-opening second recess 34 extending downwardly from the top surface 22, where the second recess 34 includes a bottom wall 36 that may extend over a majority over the top surface 22. As best illustrated in FIG. 5, the second recess 34 may be configured to receive a food cutting and preparation insert 38 therein, where the insert 38 comprises a material such as Corian, wood, polymaterials, metal, or other materials suitable for the cutting and preparation of foodstuffs. The table top 20 (FIGS. 3 and 4) may also include one or more downwardly-opening third recesses 40 having a top wall 42, wherein the third recess 40 is configured to reduce the overall material of the body portion 28 thereby reducing the overall weight thereof.

Figure 6:
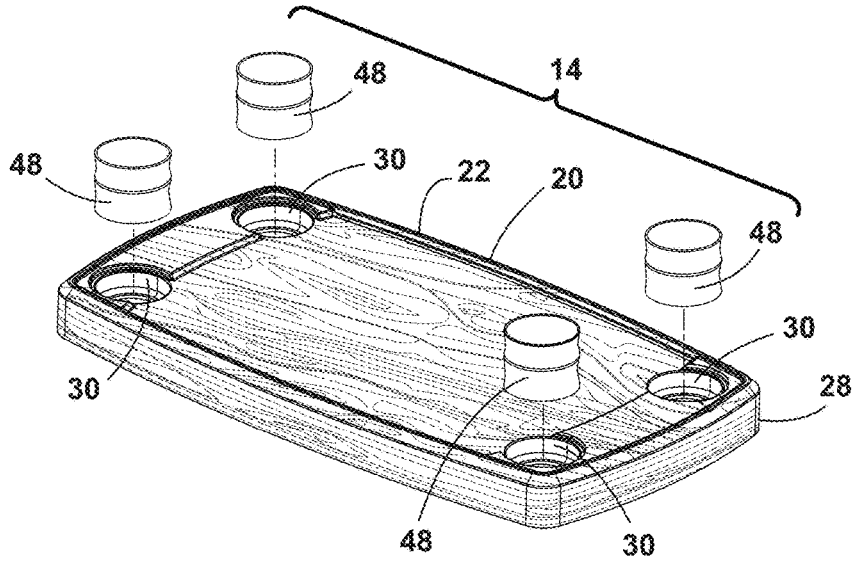
FIG. 6 is an exploded perspective view of the table top assembly having another alternative configuration and including drink-holder receptacles.
Figure 7:
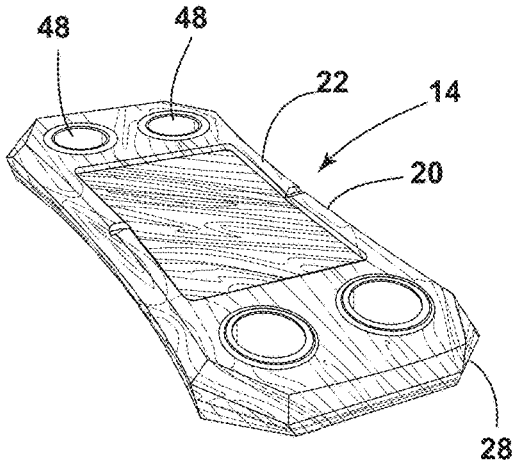
FIG. 7 is a perspective view of the table assembly having yet another alternative geometrical configuration.
Figure 8:
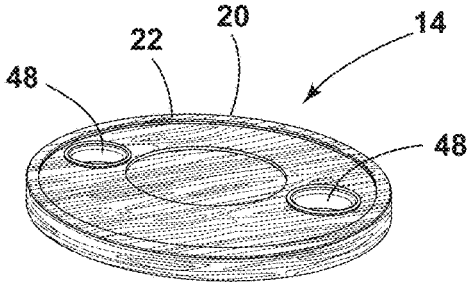
FIG. 8 is a top perspective view of the table assembly of yet another alternative geometrical configuration.

The table top 20 may also include a peripherally-extending lip or rim 44 (FIGS. 2 and 4) that includes one or more reliefs 46 extending therethrough and configured so as to allow fluids that collect on the top surface 22 or within the second recess 34 to drain therefrom. As best illustrated in FIGS. 6 and 7, the table top assembly 14 may include a plurality of inserts 48 received within corresponding first recesses 30, where each insert 48 comprises a material that is different than the polyurethane material from which the body portion 28 is constructed, such as metal, ABS plastic, and the like. As best illustrated in FIG. 6, the inserts 48 are press-fit within the corresponding first recesses 30, and/or are connected to the table top 20 via snap connections, or mechanical fasteners extending upwardly through the table top 20. As best illustrated in FIG. 7, the inserts 48 are in-molded within the corresponding first recesses 30 of the table top 20.

The table top 20 (FIG. 4) may also include electrical passages 52 extending through the body portion 26 and configured to route electrical wires 54 therethrough to provide power to electrical components such as lights 56 that may be located to illuminate the first recesses 30, and/or electrical charging ports 58, such as USB connectors. The electrical passageways may be integrally molded into the table top 20 during the molding thereof, and/or machined into the table top 20 subsequent to molding. The electrical wires 54, the lights 56, the electrical charging ports 58, and/or other electrical components may be in-molded within the table top 20 during molding thereof, and/or added subsequent thereof.

As best illustrated in FIGS. 1 and 3, the support assembly 18 may include a base member 60 attached to the deck 16, a tubular support leg 62 telescopingly received within an aperture 64 of the base member 60, and a mounting member 66 attached to the bottom surface 24 of the table top 20 by a plurality of mechanical fasteners such as screws 68. It is noted that the support assembly 18 may be provided in alternative configurations and arrangements adequate to support the table top assembly 14.

Figure 9:
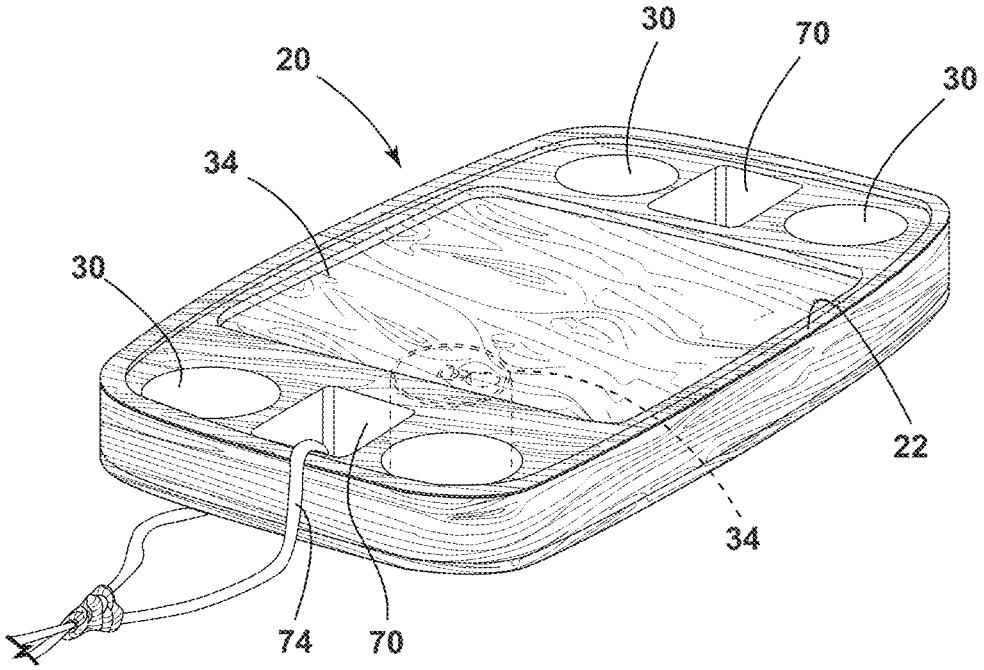
FIG. 9 is a perspective view of a table top of the table top assembly, shown removed from the table assembly and configured to float.

The table top 20 is constructed via a method that includes selecting a desired overall shape and pattern for the table top 20, examples of which are illustrated in FIGS. 1-3, FIG. 5, FIG. 6, FIG. 7 and FIG. 8. A surface pattern for at least one of the top surface 22 and the side surfaces 26 is also selected. In the illustrated example, the surface pattern may include wood, such as a walnut wood, and/or other desirable wood species. The wood is cut into strips approximately 1" in width and a length and thickness approximate to the overall desired dimensions of the table. The strips of woods are then selected by alternating wood grains from straight to cathedral to produce an aesthetically pleasing and distinct wood grain pattern. The strips of wood are subsequently glued together with an epoxy and then drum sanded to the desired thickness, with the specific dimensions of the desired table being machined from the wood blank constructed of the strips of wood. The wood blank is placed in a mold box which is subsequently filled with a silicon mixed with a catalyst, which is then heat treated for 24 hours to cure the silicon. The silicon mold is then separated from the wood blank, thereby resulting in a silicon mold that includes the desired aesthetic wood grain qualities and patterns. Each component, such as the table top 20 is produced by applying a mold release toner to the silicon mold prior to filling the mold with a combination of the polyol and the isocyanate. The silicon mold with the polyol/isocyanate mixture is placed into a press and allowed to cure for approximately 20 minutes. Once the polyol/isocyanate mixture has cured, the table top 20 comprised of the polyurethane foam is separated from the mold. In the instant example, the polyurethane foam of the table top 20 preferably has a density of between about 18 and about 27 $lbs/ft^3$, and more preferably a density of between about 20 $lbs/ft^3$ and 25 $lbs/ft^3$. As a result, and as best illustrated in FIG. 9, the table top 20 has a density that is significantly less than that of water, thereby allowing the table top 20 to be separated from the remainder of the table assembly 10 and used as a floatation device to support beverages, foodstuffs, beach items, and the like. The table top 20 (FIG. 9) may include one or more upwardly-opening accessory recesses 70, where at least a portion of the accessory recess 70 extends completely from the top surface 22 to the bottom surface 24, thereby allowing a tether such as a rope 74 to be secured to the table top 20 and to the associated boat or anchored and prevent the table top 20 from drifting away. The table top 20 may also be coated with one or more aesthetic and/or protective coatings. For example, the table top 20 may be coated with a colored paint or stain, and then glazed or wiped to achieve a desired look, and/or coated with a clear coat protective layer.

Figure 10:
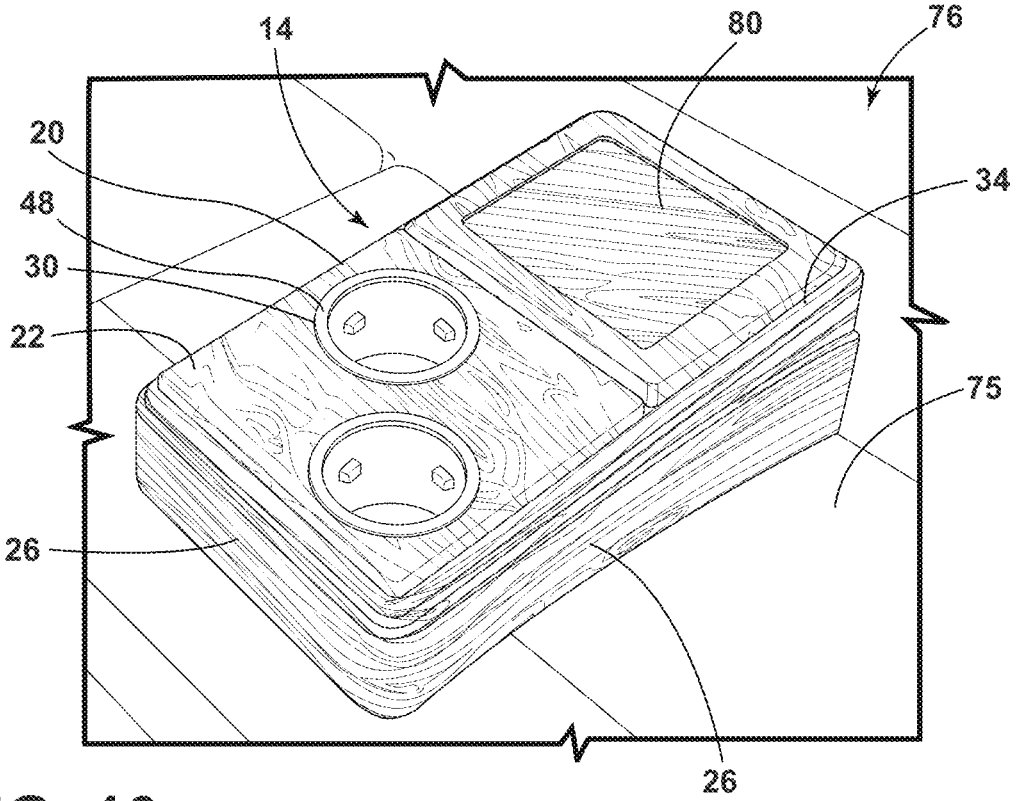
FIG. 10 is a perspective view of an alternative embodiment of the table assembly.

As best illustrated in FIG. 10, the table top assembly 14 may be configured to be supported by a furniture unit, such as the seat 75 of a chair 76. In the instant example, the second recess 34 is configured to receive an arm cushion 80 therein.

The embodiments as disclosed herein provide marine accessories and components, and in particular table assemblies having an improved quality, a more durable performance, improved aesthetics, are relatively lightweight, are water resistant, are water buoyant, while simultaneously reducing related costs, particularly to short-run batches, and a method for producing the same, and are particularly well adapted for the proposed use.

In the foregoing description, it will be readily appreciated by those skilled in the art that modifications may be made to the embodiments as disclosed herein without departing from the concepts as disclosed herein. Such modifications are to be considered as included in the following claims, unless the claims by their express language state otherwise.

The invention claimed is:

1. A table top assembly for a watercraft table assembly, comprising:

an upwardly-disposed top surface;

a downwardly-disposed bottom surface spaced vertically from the top surface;

a plurality of side surfaces extending between the top and bottom surfaces and cooperating with the top and bottom surfaces to form a body portion; and an insert member comprising a material different than the body portion, wherein the insert member is in-molded within the body portion;

wherein the body portion comprises polyurethane foam having a density within a range of between about 18 lbs/ft$^3$ and about 27 lbs/ft$^3$, and wherein the body portion has a substantially homogeneous composition throughout; and wherein one or more of the top surface and the plurality of side surfaces includes an integrally molded textured surface.

2. The table top assembly of claim 1, wherein the density is within a range of between 20 lbs/ft$^3$ and 25 lbs/ft$^3$.

3. The table top assembly of claim 1, wherein the top surface includes an upwardly-opening first recess.

4. The table top assembly of claim 3, wherein the first recess is configured to receive a drink receptacle therein.

5. A table top assembly for a watercraft table assembly, comprising:

an upwardly-disposed top surface;

a downwardly-disposed bottom surface spaced vertically from the top surface; and a plurality of side surfaces extending between the top and bottom surfaces and cooperating with the top and bottom surfaces to form a body portion;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface;

wherein the top surface includes an upwardly-opening first recess;

wherein the first recess is configured to receive a drink receptacle therein; and wherein at least a portion of the first recess extends entirely from the top surface to the bottom surface.

6. A table top assembly for a watercraft table assembly, comprising:

an upwardly-disposed top surface;

a downwardly-disposed bottom surface spaced vertically from the top surface;

a plurality of side surfaces extending between the top and bottom surfaces and cooperating with the top and bottom surfaces to form a body portion;

an insert member comprising a material that is different than the body portion and configured to receive a drink receptacle therein, wherein the insert member configured to receive the drink receptacle is located within an upwardly-opening first recess of the top surface;

wherein the body portion comprises polyurethane foam having a density within a range of between about 18 lbs/ft$^3$ and about 27 lbs/ft$^3$, and wherein the body portion has a substantially homogeneous composition throughout; and wherein one or more of the top surface and the plurality of side surfaces includes an integrally molded textured surface.

7. The table top assembly of claim 6, wherein the insert member configured to receive the drink receptacle is in-molded within the first recess.

8. The table top assembly of claim 3, wherein the top surface includes an upwardly-opening second recess configured differently than the first recess.

9. A table top assembly for a watercraft table assembly, comprising:

an upwardly-disposed top surface;

a downwardly-disposed bottom surface spaced vertically from the top surface; and a plurality of side surfaces extending between the top and bottom surfaces and cooperating with the top and bottom surfaces to form a body portion;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface;

wherein the top surface includes an upwardly-opening first recess;

wherein the top surface includes an upwardly-opening second recess configured differently than the first recess; and wherein the second recess includes an upwardly-disposed bottom wall that extends over a majority of the top surface.

10. A table top assembly for a watercraft table assembly, comprising:

an upwardly-disposed top surface;

a downwardly-disposed bottom surface spaced vertically from the top surface;

a plurality of side surfaces extending between the top and bottom surfaces and cooperating with the top and bottom surfaces to form a body portion; and an inlay comprising a material different than the body portion and configured to be used as a cutting surface, wherein the inlay is received within the second recess;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface;

wherein the top surface includes an upwardly-opening first recess; and wherein the top surface includes an upwardly-opening second recess configured differently than the first recess.

11. A table top assembly for a watercraft table assembly, comprising:

an upwardly-disposed top surface;

a downwardly-disposed bottom surface spaced vertically from the top surface; and a plurality of side surfaces extending between the top and bottom surfaces and cooperating with the top and bottom surfaces to form a body portion;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface;

wherein the top surface includes an upwardly-opening first recess;

wherein the top surface includes an upwardly-opening second recess configured differently than the first recess; and wherein the bottom surface includes a downwardly-opening third recess, and wherein the third recess includes a top wall.

12. A table top assembly for a watercraft table assembly, comprising:

an upwardly-disposed top surface;

a downwardly-disposed bottom surface spaced vertically from the top surface; and a plurality of side surfaces extending between the top and bottom surfaces and cooperating with the top and bottom surfaces to form a body portion;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface; and wherein the body portion includes an upwardly-extending rim extending about at least a majority of an outer periphery of the body portion, and wherein the rim includes a fluid relief extending downwardly from an uppermost edge of the rim, thereby allowing fluid collected on the top surface to travel through the fluid relief.

13. A table top assembly for a watercraft table assembly, comprising:

an upwardly-disposed top surface;

a downwardly-disposed bottom surface spaced vertically from the top surface; and a plurality of side surfaces extending between the top and bottom surfaces and cooperating with the top and bottom surfaces to form a body portion;

wherein the body portion comprises polyurethane foam having a density within a range of between about 18 lbs/ft$^3$ and about 27 lbs/ft$^3$, and wherein the body portion has a substantially homogeneous composition throughout;

wherein one or more of the top surface and the plurality of side surfaces includes an integrally molded textured surface; and wherein the body portion includes one or more integrally molded electrical pathways configured to receive one or more electrical wires therethrough.

14. A table top assembly for a watercraft table assembly, comprising:

an upwardly-disposed top surface;

a downwardly-disposed bottom surface spaced vertically from the top surface;

a plurality of side surfaces extending between the top and bottom surfaces and cooperating with the top and bottom surfaces to form a body portion; and one or more electrical wires in-molded within the body portion;

wherein the body portion comprises polyurethane foam having a density within a range of between about 18 lbs/ft$^3$ and about 27 lbs/ft$^3$, and wherein the body portion has a substantially homogeneous composition throughout; and wherein one or more of the top surface and the plurality of side surfaces includes an integrally molded textured surface.

15. A table top assembly for a watercraft table assembly, comprising:

an upwardly-disposed top surface;

a downwardly-disposed bottom surface spaced vertically from the top surface;

a plurality of side surfaces extending between the top and bottom surfaces and cooperating with the top and bottom surfaces to form a body portion; and one or more electrical components in-molded within the body portion;

wherein the body portion comprises polyurethane foam having a density within a range of between about 18 lbs/ft$^3$ and about 27 lbs/ft$^3$, and wherein the body portion has a substantially homogeneous composition throughout; and wherein one or more of the top surface and the plurality of side surfaces includes an integrally molded textured surface.

16. The table top assembly of claim 15, wherein the one or more electrical components includes a light, an electrical charger, and/or a communications port.

17. A table assembly, comprising:

the table top assembly as defined of claim 1; and a table support assembly attached to the table top and configured to support the table top above a supporting surface of the watercraft.

18. The table assembly of claim 17, wherein the table support assembly includes a mounting member attached to the bottom surface of the table top and a support leg telescopingly-received with the mounting member.

19. The table assembly of claim 1, wherein the integrally molded textured surface includes a wood grain pattern.

20. A table top assembly for a watercraft table assembly, comprising:

a top surface having an upwardly-opening first recess configured to receive a beverage receptacle and an upwardly-opening second recess configured differently than the first recess, wherein the second recess extends over a majority of the top surface;

a bottom surface spaced vertically from the top surface and having a downwardly-opening third recess, the third recess having a top wall; and a plurality of side surfaces extending between the top and bottom surfaces and cooperating with the top and bottom surfaces to form a body portion;

wherein the body portion comprises polyurethane foam having a density within a range of between about 20 $lbs/ft^3$ and about 25 $lbs/ft^3$, and wherein the body portion has a substantially homogeneous composition throughout; and wherein one or more of the top surface and the plurality of side surfaces include an integral wood-grain pattern.

21. A table assembly, comprising:

the table top assembly as defined of claim 20; and a table support assembly attached to the table top and configured to support the table top above a supporting surface of the watercraft.

22. A method for producing a table top assembly for a watercraft, comprising:

providing a mold comprising silicon, the mold including a wood grain textured surface;

placing a mixture of polyol and isocyanate into the mold;

allowing the mixture of polyol and isocyanate to set into a substantial homogenous body portion of a table top comprising polyurethane foam having a density of within a range of between about 20 $lbs/ft^3$ and about 25 $lbs/ft^3$; and removing the table top from the mold, wherein the body portion of the table top includes an upwardly disposed top surface, a downwardly disposed bottom surface spaced vertically from the top surface, and a plurality of side surfaces extending between the top and bottom surfaces, and wherein one or more of the top surface and the plurality of side surfaces includes an integral wood-grain pattern.

23. The table top assembly of claim 1, wherein the insert member includes one or more electrical wires.

24. The table top assembly of claim 1, wherein the insert member includes a beverage receptacle.

* * * * *